US007647737B2

(12) United States Patent
Morello

(10) Patent No.: US 7,647,737 B2
(45) Date of Patent: Jan. 19, 2010

(54) BUILDING PANEL AND BUILDING STRUCTURE

(75) Inventor: Frederick Morello, Johnstown, PA (US)

(73) Assignee: M.I.C. Industries, Inc., Reston, VA (US)

( * ) Notice: Subject to any disclaimer, the term of this patent is extended or adjusted under 35 U.S.C. 154(b) by 641 days.

(21) Appl. No.: 10/966,760

(22) Filed: Oct. 15, 2004

(65) Prior Publication Data

US 2006/0080905 A1 Apr. 20, 2006

(51) Int. Cl.
*E04B 1/32* (2006.01)

(52) U.S. Cl. ..... 52/245; 52/521; 52/86; 52/798.1

(58) Field of Classification Search ..... 52/86, 52/120, 245, 521, 798.1
See application file for complete search history.

(56) References Cited

U.S. PATENT DOCUMENTS

| | | | | |
|---|---|---|---|---|
| 2,436,543 | A * | 2/1948 | Blaski | 52/521 |
| 3,009,509 | A | 11/1961 | Martin | |
| 3,173,225 | A | 3/1965 | Goodwill et al. | |
| 3,276,171 | A | 10/1966 | Brown | |
| 3,300,923 | A * | 1/1967 | Behlen | 52/245 |
| 3,842,647 | A | 10/1974 | Knudson | |
| 3,902,288 | A | 9/1975 | Knudson | |
| 4,301,628 | A | 11/1981 | Lowe | |
| 4,358,916 | A | 11/1982 | Lacasse | |
| 4,364,253 | A | 12/1982 | Knudson | |
| 4,472,473 | A | 9/1984 | Davis et al. | |
| 4,505,084 | A | 3/1985 | Knudson | |
| 4,505,143 | A | 3/1985 | Knudson | |
| 4,759,159 | A | 7/1988 | Blazley | |
| 4,962,622 | A | 10/1990 | Albrecht et al. | |
| 5,249,445 | A | 10/1993 | Morello | |
| 5,359,871 | A | 11/1994 | Morello | |
| 5,375,943 | A | 12/1994 | McCavour et al. | |
| 5,584,198 | A | 12/1996 | Morello | |
| 5,651,226 | A | 7/1997 | Archibald | |
| 5,655,338 | A | 8/1997 | Lucas | |
| 6,260,323 | B1 | 7/2001 | Hockey | |
| 6,282,936 | B1 | 9/2001 | Blazley | |
| 6,419,302 | B2 | 7/2002 | Mikuni | |
| 6,543,197 | B2 | 4/2003 | Wetzel, III et al. | |
| 6,722,087 | B1 | 4/2004 | Morello | |
| 2003/0000156 | A1 | 1/2003 | Morello et al. | |

FOREIGN PATENT DOCUMENTS

| | | |
|---|---|---|
| CN | 2152845 Y | 1/1994 |
| DE | 1684709 | 6/1971 |

(Continued)

*Primary Examiner*—Basil Katcheves
(74) *Attorney, Agent, or Firm*—Jones Day

(57) ABSTRACT

An improved building panel with increased stiffness and resistance to buckling is disclosed. The panel cross section is characterized by a novel center portion comprised of radially arranged longitudinal stiffening ribs which transition into side portions configured to allow joining of the panels. The configuration of the panel's center section results in an increased moment of inertia as well as higher resistance to positive and negative bending moments and local buckling when compared to existing designs. Additionally, the panel configuration allows curving longitudinally without corrugations. These improvements in the strength of the panel and the elimination of corrugations reduce design constraints on buildings constructed of such panels and allow larger buildings to be constructed.

17 Claims, 11 Drawing Sheets

FOREIGN PATENT DOCUMENTS

| | | |
|---|---|---|
| GB | 770062 | 3/1957 |
| HU | 181342 B | 3/1985 |
| HU | 189778 B | 7/1988 |
| HU | 190331 B | 7/1988 |
| HU | 203688 B | 9/1991 |
| JP | S 63-280148 | 11/1988 |
| JP | H 06-280352 | 10/1994 |
| NZ | 338021 | 3/1998 |
| NZ | 531441 | 6/2004 |
| WO | WO 98/45064 | 10/1998 |
| WO | WO 03/018927 | 3/2003 |

* cited by examiner

BUILDING PANEL AND BUILDING STRUCTURE

TECHNICAL FIELD

This invention is related to a novel building panel and building structure comprised of a plurality of interconnected panels. This invention also relates to a novel method of curving a building panel without crimping.

BACKGROUND OF THE PRIOR ART

In conventional construction, buildings are constructed of a combination of columns or posts and beams, which are then covered by plywood or some sort of metal or plastic sheeting. In an effort to reduce the construction time and expense, contractors often construct buildings, and particularly, the exterior walls of buildings, with prefabricated building panels. Constructing a building with such panels increases construction productivity and reduces expense by virtue of the fact that entire walls are manufactured at the construction site, so that they can be swiftly combined and the building erected.

These prefabricated panels are typically manufactured from steel sheet metal, and configured to conform to the desired shape of the building. However, the flexibility and strength characteristics of the sheet metal combine to limit the shape of buildings that can be constructed quickly. A common shape is the arch style building 10, such as the one illustrated in FIG. 1, which is comprised of a plurality of interconnected arch shaped panels. The panels are interconnected by placing them adjacent one another and forming a sealed joint where the edges of the panels overlap.

In addition to constructing arch shaped buildings, panels may be used to construct gable style buildings 20 and double radius style buildings 30, such as those illustrated in FIGS. 2 and 3, respectively. Although not shown, interconnected panels can also be used to construct straight sided buildings or portions thereof. Regardless of whether the building has a curved or straight profile, the cross section of the panels used to construct such buildings are often similar.

The size of such self-supporting buildings constructed of steel or other materials is limited in size by the ability of the building material to withstand the forces that act on it when it is formed into a building panel and combined with other building panels to construct a building. Wind, snow, live load and dead load create internal stresses within each building panel which must not exceed the capacity of the panel. Each of these internal stresses have components that include axial, positive bending, negative bending and shear. As a building is made larger, the external forces result in greater stresses, again with axial, bending, and shear components. For example, as more snow accumulates on the roof of a building, the wind necessarily acts against a larger cross sectional surface area, since the area of the snow that is exposed to the wind is added to the area of the building that is exposed to the wind. Additionally, the dead load, due to the weight of the panel itself, increases as the length of the panel increases. In order to allow the construction of larger self-supporting structures it is therefore desirable to increase each panel's ability to resist axial stress, positive bending stress, negative bending stress and shear stress.

The common panel cross section 100 typical of a prior art building panel shown in FIG. 4 has a significantly lower capacity for withstanding negative bending moments (i.e., moments that act to cause the panel to bend in a concave direction), than for positive bending moments (i.e., moments that act to cause the panel to bend in a convex direction). The size of a bending moment is a function of the amount of forces acting upon a building panel and the distance between the points where such forces apply. Thus, as either the amount of forces or the distance between the forces increases, so does the bending moment increase.

FIG. 4 illustrates a cross section of a known building panel typically used to construct such buildings. The typical prior art building panel 100 includes a central portion 102 and two inclined side wall portions 104, 106 extending from opposite ends of the central portion 102. The central portion 102 is straight, and in order to increase that portion's stiffness it may include what is commonly referred to as a notched portion or stiffening rib 116. Although the central portion 102 may include a notched stiffener or stiffening rib 116 and therefore can be considered to comprise two sub-central portions, typical prior art building panels have a generally continuous, or continuously straight central portion 102 despite the inclusion of a notched portion or stiffening rib 116. Although such a feature is not shown, the inclined side wall portions 104, 106 may also include notches to stiffen those portions of the building panel.

Continuing to refer to FIG. 4, the building panel 100 further includes two wing portions 108, 110 extending from the inclined side wall portions 104, 106, respectively. The wing portions 108, 110 are substantially parallel to the central portion 102 and are shown with optional notch stiffeners. A hook portion 114 extends from one wing portion 110, and a complementary hem portion 112 extends from the other wing portion 108.

The lack of adequate longitudinal stiffening in the center portion 102 results in a poor resistance to local buckling; therefore, the resistance to negative bending is reduced.

In addition to these deficiencies, typical construction methods of forming building panels and constructing buildings using the building panels of the prior art used corrugations to allow curving in the longitudinal direction. The corrugations further weaken the panel's resistance to axial compression and negative bending moments.

OBJECTS OF THE INVENTION

It is an object of this invention to provide an improved building panel with an increased ability to withstand both positive and negative bending moments.

It is another object of this invention to provide an improved building panel with an increased moment of inertia of the panel cross section without significantly affecting the width.

A further object of this invention is to provide an improved building panel with a high resistance to local buckling within the panel.

It is an additional object of this invention to provide an improved building panel that can be curved longitudinally without crimping.

It is yet a further object of this invention to provide an improved building panel that permits an increased size of buildings which may be constructed of interconnected building panels.

SUMMARY OF THE INVENTION

The present invention is an improved building panel with increased resistance to positive and negative bending moments and local buckling. Additionally, the moment of inertia of the cross section is improved without significantly reducing the ratio of finished panel width to raw material width. This cross section is also applicable to a unique method of curving the panel longitudinally without corrugations.

The improved building panel is characterized by a novel center section including an approximately radial pattern of alternating segments that project inwardly and outwardly from the nominal radius of the building material. The combination of the inwardly and outwardly located segments results in longitudinal stiffeners which resist local buckling and improve the strength of the central portion of the panel. The center section transitions through radii into a pair of complementary wing portions on either side. The wing portions contain elements suitable for joining panels side by side, typically by continuous seaming.

These improved building panels can be used to construct buildings or portions of buildings when multiple panels are joined or seamed side by side. When the panels are curved longitudinally before seaming, buildings of different shapes can be constructed. The combination of the improved stiffness characteristics of the cross section and the ability of the panel to be curved without crimping permits the construction of larger buildings without increasing the thickness or yield strength of the building material.

DETAILED DESCRIPTION OF THE PREFERRED EMBODIMENTS

Figure 1:
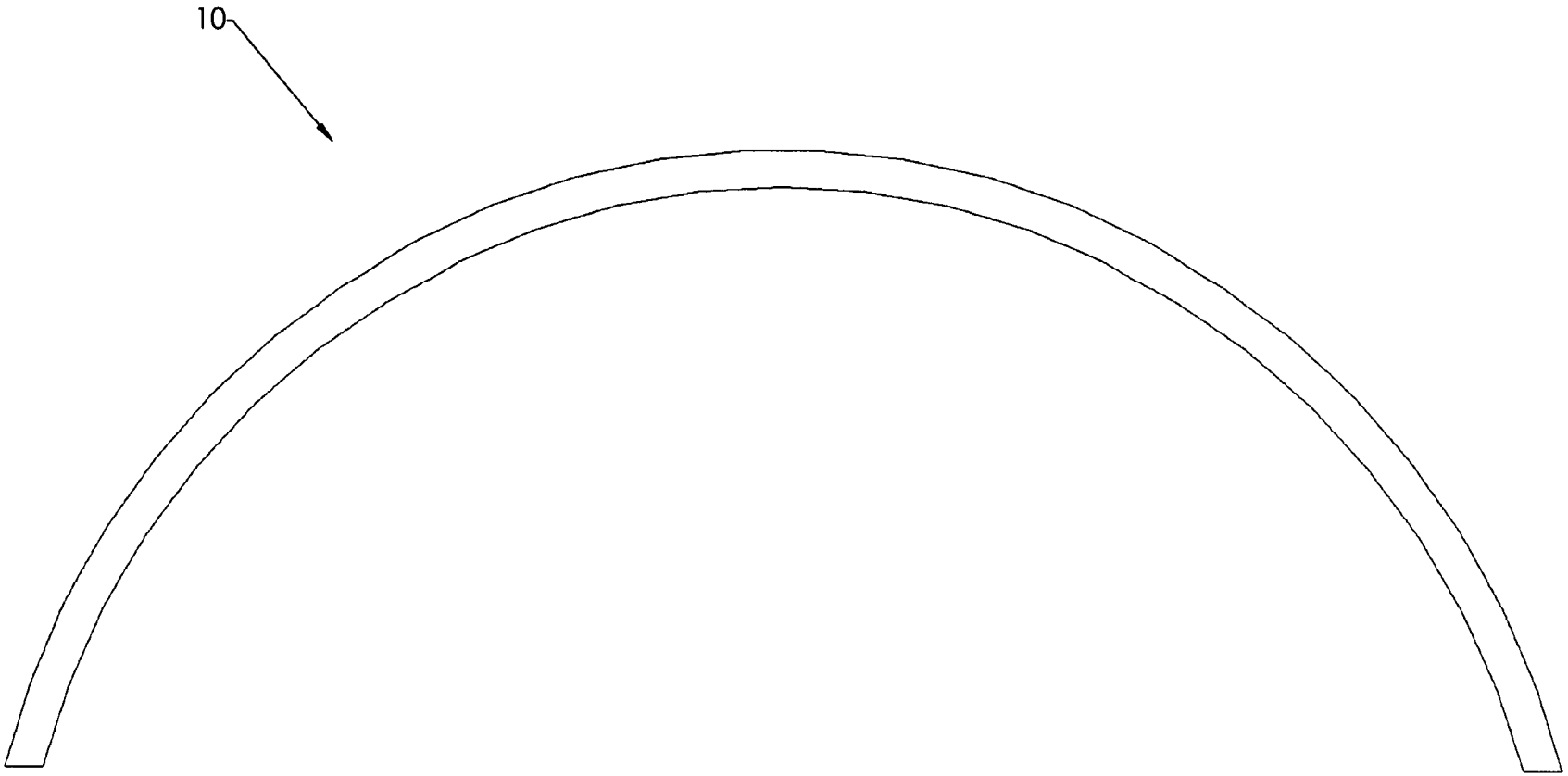
FIGURE 1 PRIOR ART
FIG. 1 is a cross sectional end view of an arch style building in the prior art, constructed of a plurality of building panels.
Figure 2:
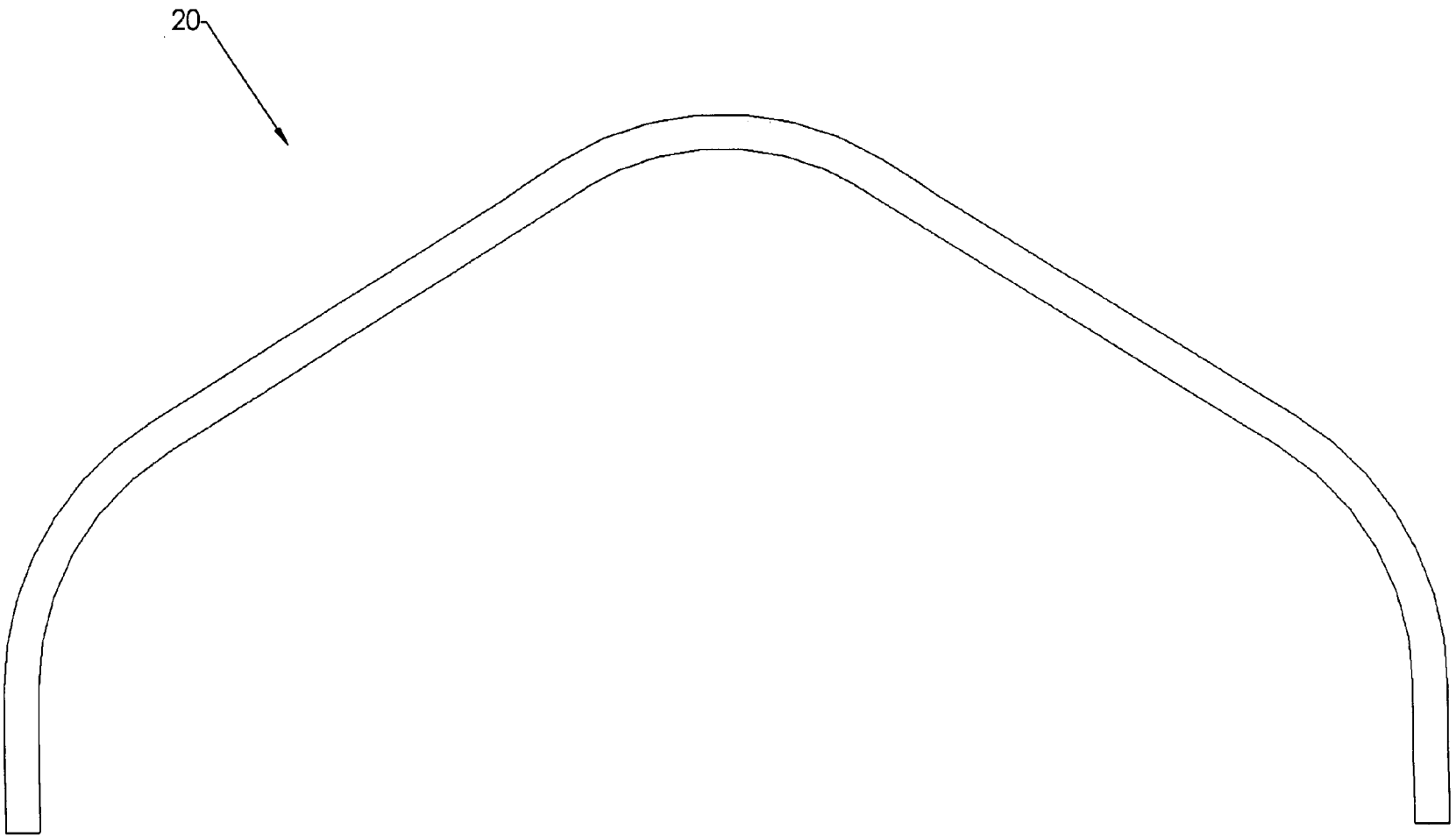
FIGURE 2 PRIOR ART
FIG. 2 is a cross sectional end view of a gable style building in the prior art, constructed of a plurality of building panels.
Figure 3:
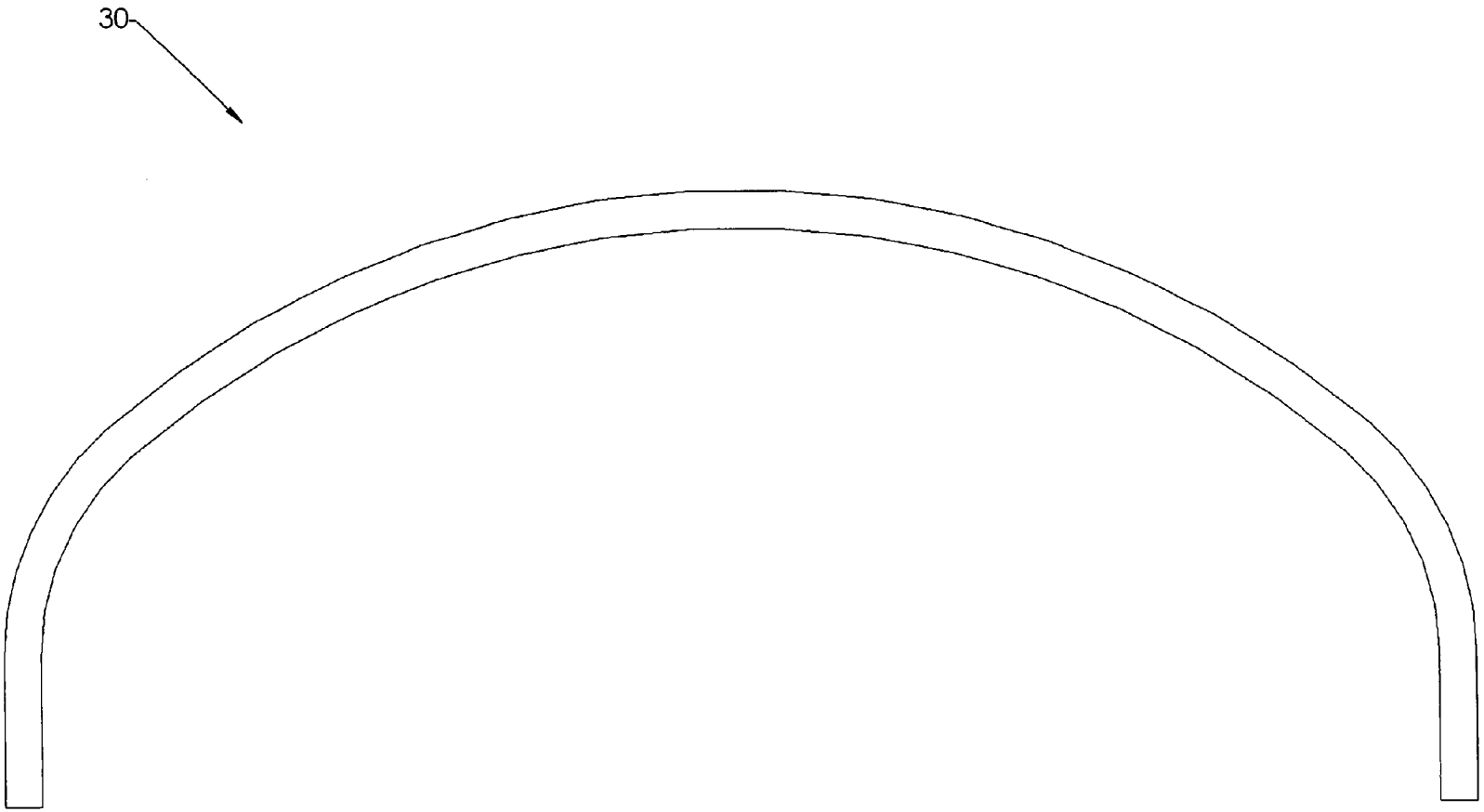
FIGURE 3 PRIOR ART
FIG. 3 is a cross sectional end view of a double radius style building in the prior art, constructed of a plurality of building panels.
Figure 4:
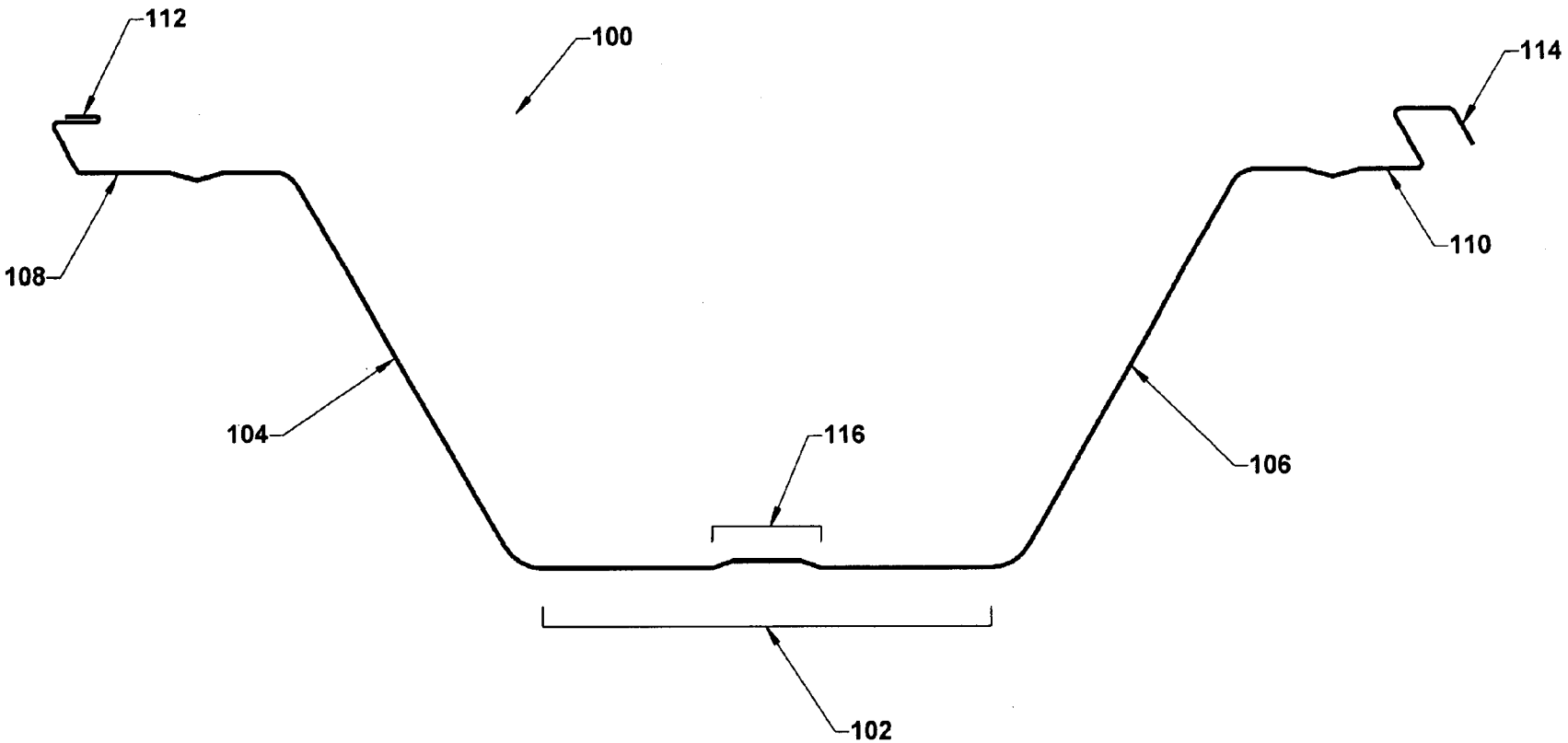
FIGURE 4 PRIOR ART
FIG. 4 is an example of a building panel of the prior art.
Figure 5:
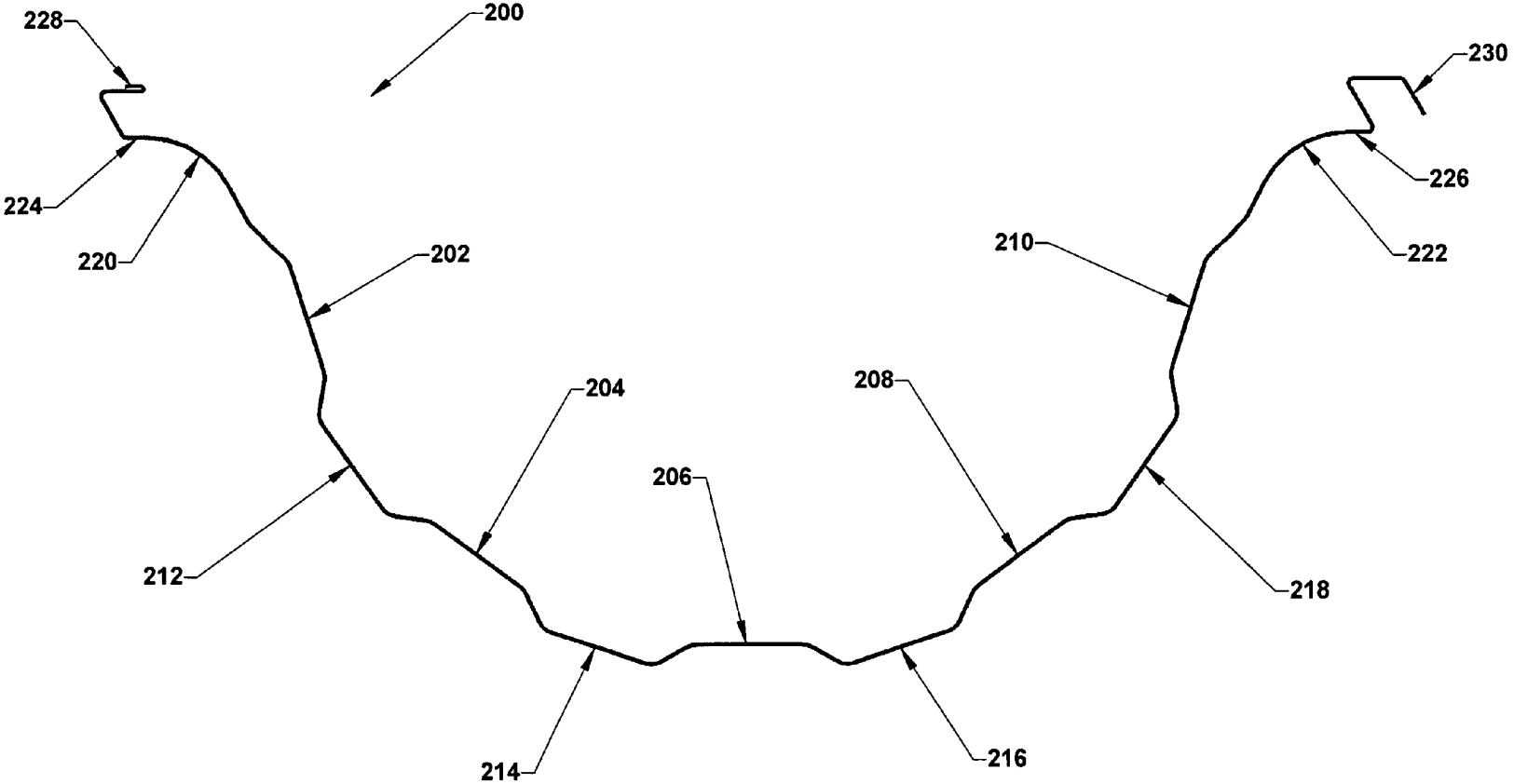
FIG. 5 is a cross sectional view of an embodiment of the improved building panel comprising the present invention.

Referring now to the drawings, FIG. 5 shows an improved building panel 200 formed from a single roll of ASTM A-653 steel sheet metal with a thickness ranging from about 24 gauge to 16 gauge. As persons of ordinary skill in the art will recognize, the metal designation is an industry standard. The panel of the present invention can be formed from any type of steel, galvalume, zincalume, aluminum, or any other building material that is suitable for construction. The building panel 200 may be formed of other thicknesses and from other sheet building materials and as long as they possess the desired engineering properties.

Figure 5A:
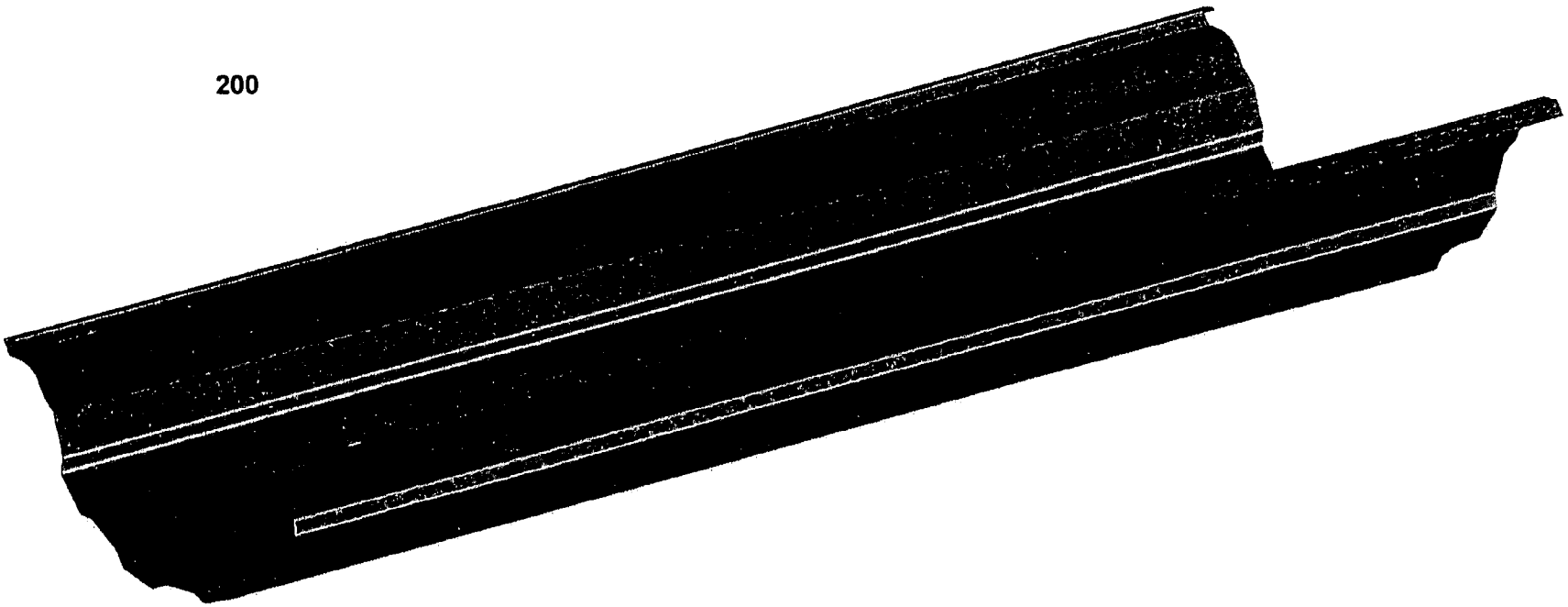
FIG. 5A is an orthogonal view of an embodiment of the improved building panel comprising the present invention.

The improved panel 200 is characterized by a center portion having alternating inwardly and outwardly located segments in an approximately radial pattern. For reference purposes, inward means closer to the geometric center of the cross section and outward means farther from the geometric center of the cross section. The combination of the inward segments 202, 204, 206, 208 and 210 and the outward segments 212, 214, 216 and 218 forms longitudinal ribs which stiffen the panel against local buckling. The longitudinal ribs are shown clearly in the orthogonal view depicted in FIG. 5A. The preferred embodiment illustrated in FIG. 5 contains five inward segments and four outward segments but other embodiments of the improved building panel may include different combinations. For example, four inward segments and five outward segments may be used, and such a configuration will have increased resistance to positive bending moments relative to the embodiment shown in FIG. 5. Conversely, the same building panel with four inward segments and five outward segments would have a reduced resistance to negative bending moments relative to the embodiment shown in FIG. 5. Other sizes and number combinations of ribs may be used for this panel with similar improvements in structural qualities resulting.

Figure 7:
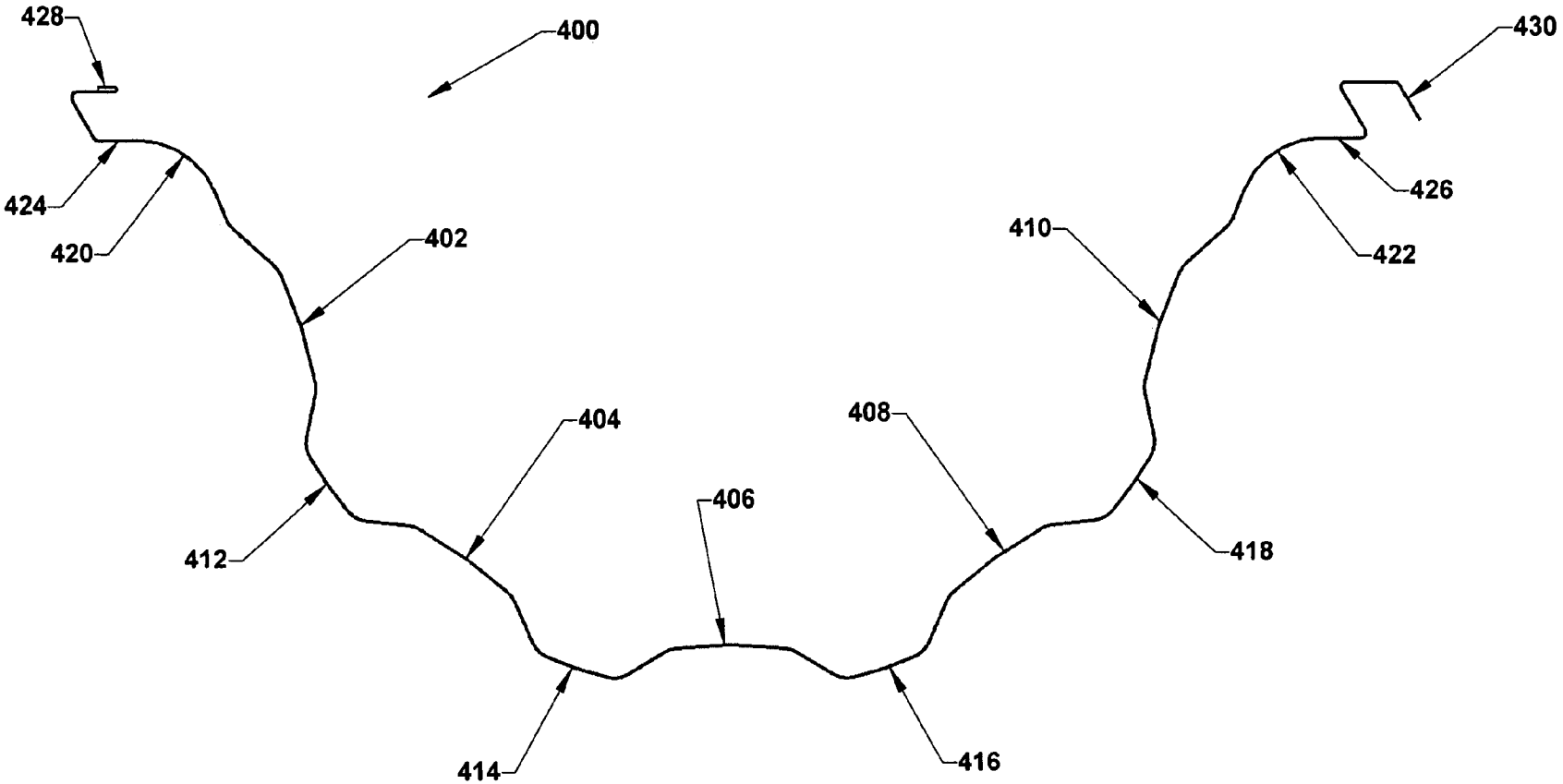
FIG. 7 is a cross sectional view of a second embodiment of the improved building panel comprising the present invention.

In the embodiment depicted in FIG. 5, the alternating segments comprise straight center subsections. As an alternative, those segments may be comprised of a radially curved center subsections, as shown in FIG. 7. Specifically, in the embodiment illustrated in FIG. 7, inward segments 402, 404, 406, 408 and 410 and outward segments 412, 414, 416 and 418 comprise segments of arc. Furthermore, as illustrated in FIG. 7 the individual alternating segments may vary in length. Specifically, in the embodiment illustrated in FIG. 7, inward segments 402, 404, 406, 408 and 410 are each of greater length than each of outward segments 412, 414, 416 and 418.

Again referring to FIG. 5, radii 220 and 222 act as transition segments to the respective complementary wing portions 224 and 226 on either side of the center portion of the building panel 200. Wing portion 226 contains a hook 230 and wing portion 224 contains a hem 228 which is designed to allow the panels to be joined side by side easily and securely.

Figure 6:
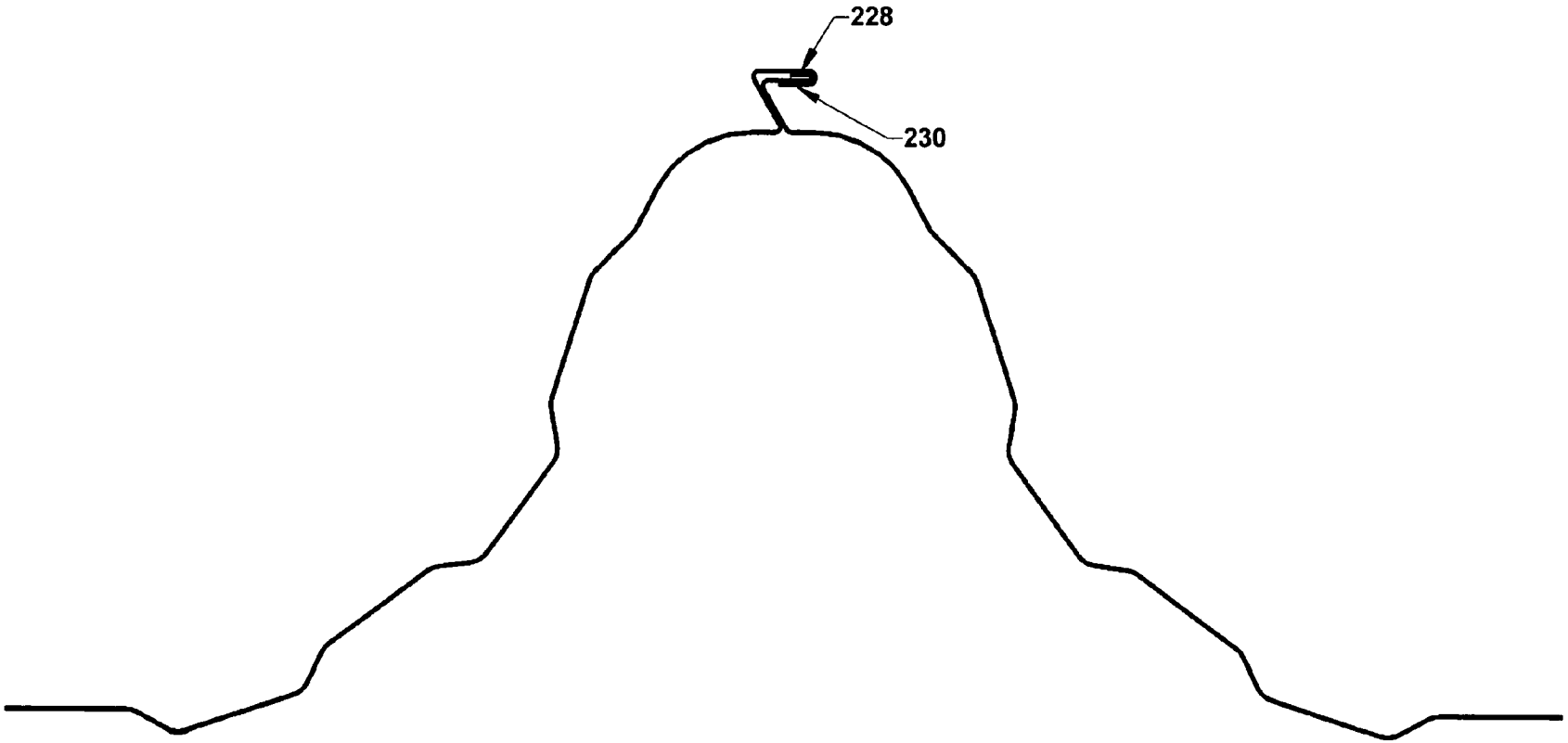
FIG. 6 is a cross sectional view of an embodiment of the connection between panels.

FIG. 6 shows and embodiment of a junction of two building panels 200 joined at the hook 230 and hem 228 by continuous seaming. In the embodiment shown in FIG. 6, the seaming process includes crimping the end of hook 230 over hem 228 to provide a secure seam. Other configurations may be used to join the panels such as different types of seams, joints, fasteners, or snap-together joints, any of which may be used with the improved building panel of the present invention.

Figure 8:
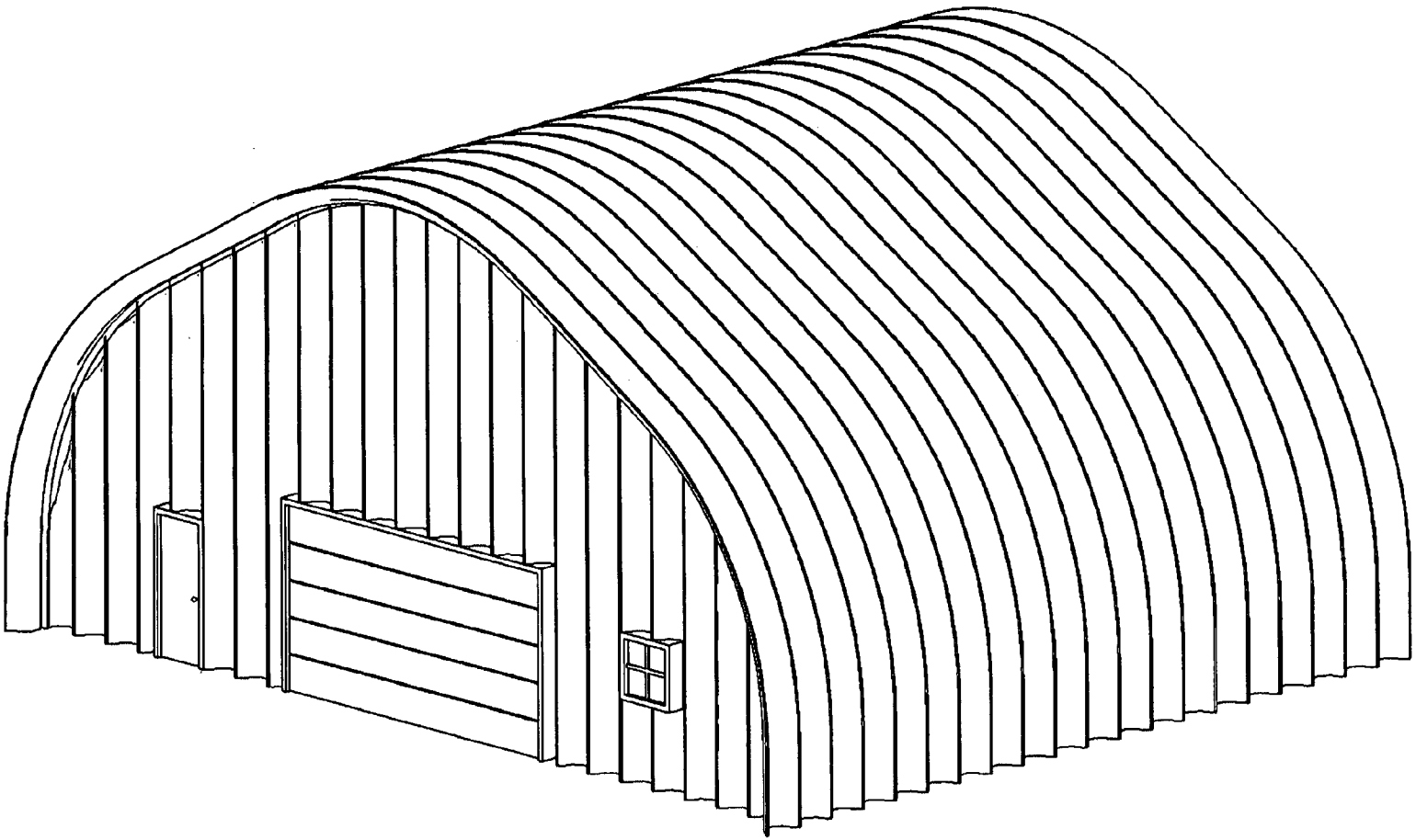
FIG. 8 is a gable style building constructed of panels.
Figure 9:
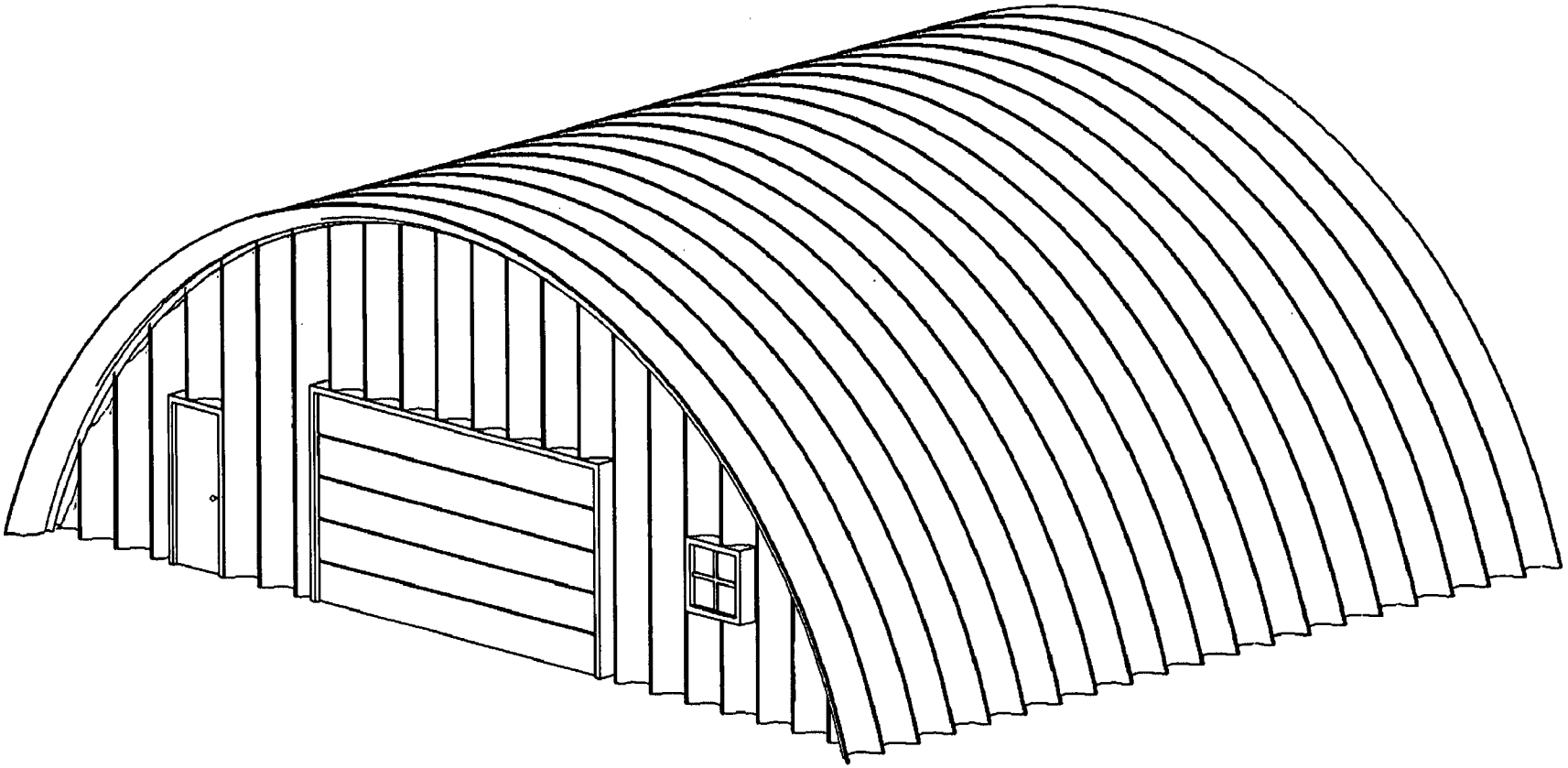
FIG. 9 is a circular style building constructed of panels.
Figure 10:
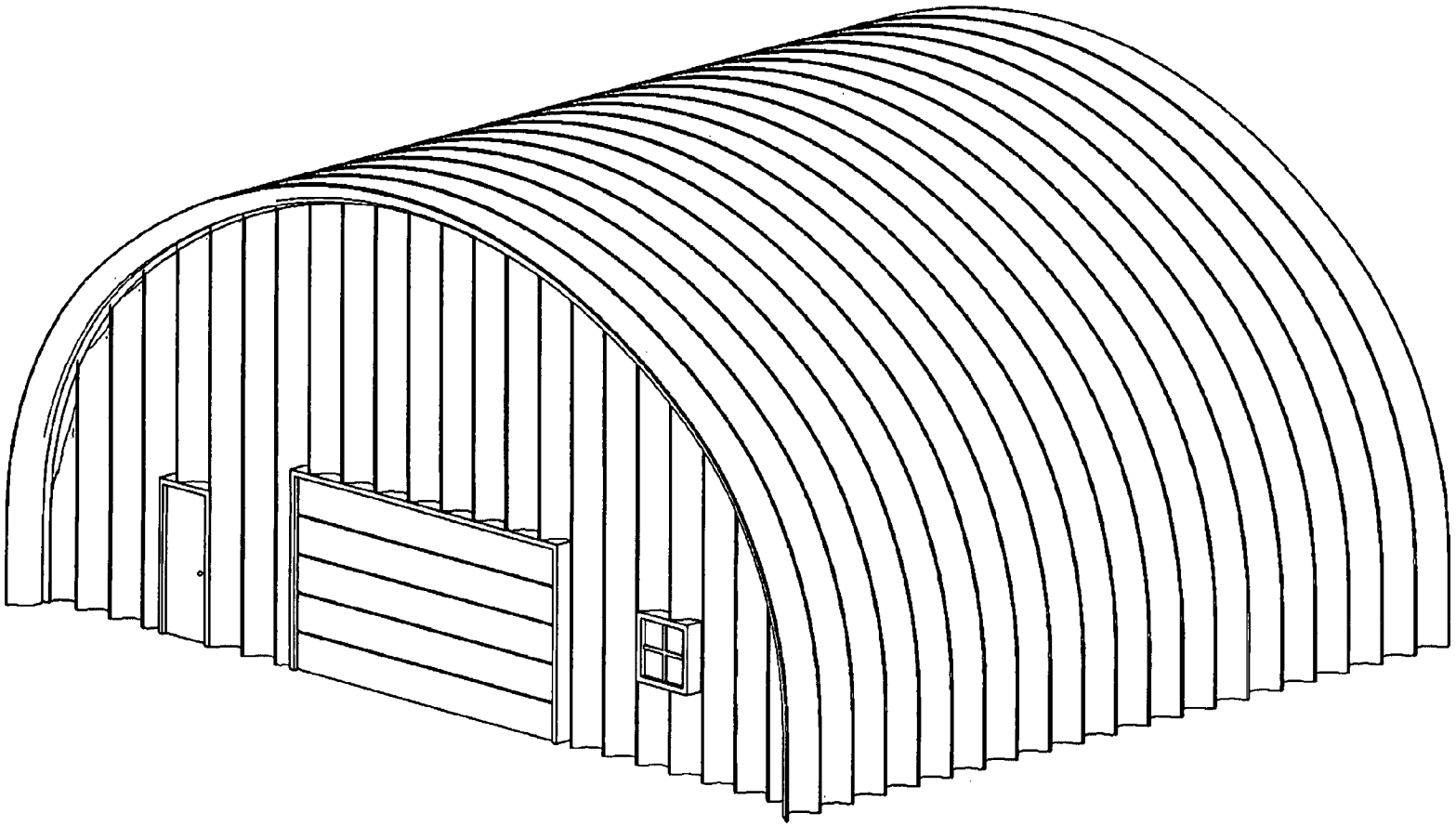
FIG. 10 is a double radius style building constructed of panels.

The improved building panel shown in the embodiments of FIG. 5 and FIG. 6 may be used to construct buildings of different shapes including gable buildings (FIG. 8), circular buildings (FIG. 9) and two radius buildings (FIG. 10). In the embodiments of buildings illustrated in FIGS. 8-10, curved panels are used to form the roof sections and straight panels are used to construct the flat end walls. Other shapes can be fabricated such as "lean to" buildings and other combinations of curved portions of various radii and straight portions so as to form a building structure.

The curved roof panels can be formed without corrugations by using a new method of curving specifically applicable to the improved building panel 200 cross section. The curving is accomplished by novel means. In the novel curving method. the radius of curvature is about the lower half of the panel, i.e. the portion that does not have the seamed edge. In one embodiment of the building panel formed by the novel curving method of the present invention, the radius of curvature can range from between infinity (straight) to a minimum of six feet. In the novel method of curving applicable to the improved building panel of the present invention, the overall depth of the shape determines the actual radius of curvature limitations. Several embodiments of the curving means include a combination of "forced and controlled buckling" and stretching and "forced and controlled buckling" alone.

I claim:

1. A building panel formed from a sheet of building material, the building panel comprising:

a curved center portion having a curved shape in cross section, the curved center portion including a plurality of stiffening ribs formed in the sheet of building material, the stiffening ribs being oriented longitudinally along a length of the building panel and being positioned within a region of the curved shape, the stiffening ribs protruding in cross section relative to said curved shape;

a pair of side portions extending from said curved center portion, the curved central portion being positioned between the side portions; and a pair of complementary wing portions extending from said side portions, each side portion being positioned between the curved central portion and one of the complementary wing portions, the building panel being curved in a longitudinal direction along the length of the building panel without transverse corrugations therein, the curved central portion being concave-shaped in cross section from a perspective between the side portions, each of the side portions being convex-shaped in cross section from a perspective between the side portions, one of the stiffening ribs being positioned halfway between the side portions along the curved shape of the curved center portion.

2. The building panel of claim 1, wherein said building material comprises sheet metal.

3. The building panel of claim 2, wherein the sheet metal has a thickness between 24 gauge and 16 gauge.

4. The building panel of claim 3, wherein the thickness of the sheet metal is within 10% of a nominal thickness gauge.

5. The building panel of claim 1, wherein at least one of the stiffening ribs protrudes outwardly in cross section from the sheet of building material from a perspective between the side portions.

6. The building panel of claim 1, wherein at least one of the stiffening ribs protrudes inwardly in cross section from the sheet of building material from a perspective between the side portions.

7. The building panel of claim 1, wherein a width of one of the stiffening ribs in cross section is different than a distance between adjacent stiffening ribs.

8. A building panel formed from a sheet of building material, the building panel comprising:

a curved center portion having a curved shape in cross section, the curved center portion including a plurality of stiffening ribs formed in the sheet of building material, the stiffening ribs being oriented longitudinally along a length of the building panel and being positioned with a region of the curved shape, the stiffening ribs protruding in cross section relative to the curved shape;

a pair of side portions extending from said curved center portion, the curved central portion being positioned between the side portions;

a pair of complementary wing portions extending from said side portions, each side portion being positioned between the curved central portion and one of the complementary wing portions;

a hook portion extending from a first one of said complementary wing portions; and a hem portion extending from a second one of said complementary wing portions, the building panel being curved in a longitudinal direction along the length of the building panel without transverse corrugations therein, the curved central portion being concave-shaped in cross section from a perspective between the side portions, each of the side portions being convex-shaped in cross section from a perspective between the side portions, one of the stiffening ribs being positioned halfway between the side portions along the curved shape of the curved center portion.

9. The building panel of claim 8, wherein said hook portion comprises a complementary shape to said hem portion, for joining said building panel to a second said building panel.

10. The building panel of claim 8, wherein one of the stiffening ribs has a width in cross section that is different than a width of another of the stiffening ribs in cross section.

11. The building panel of claim 8, wherein each of the stiffening ribs has a continuous arc shape in cross section.

12. The building panel of claim 11, wherein said arc has a radius of curvature between 10 feet and infinity.

13. The building panel of claim 8, wherein each of the stiffening ribs comprises in cross section:

a center rib portion; and a pair of side rib portions.

14. The building panel of claim 13, wherein said center rib portion is straight.

15. A building structure comprised of a plurality of building panels formed from a sheet of building material, each of said building panels comprising:

a curved center portion having a curved shape in cross section, the curved center portion including a plurality of stiffening ribs formed in the sheet of building material, the stiffening ribs being oriented longitudinally along a length of the building panel and being positioned in a region of the curved shape, the stiffening ribs protruding in cross section relative to said curved shape;

a pair of side portions extending from said curved center portion, the curved central portion being positioned between the side portions;

a pair of complementary wing portions extending from said side portions, each side portion being positioned between the curved central portion and one of the complementary wing portions;

a hook portion extending from a first one of said complementary wing portions; and a hem portion extending from a second one of said complementary wing portions, each building panel being curved in a longitudinal direction along the length of the building panel without transverse corrugations therein, the curved central portion being concave-shaped in cross section from a perspective between the side portions, each of the side portions being convex-shaped in cross section from a perspective between the side portions, one of the stiffening ribs being positioned halfway between the side portions along the curved shape of the curved center portion.

16. The building structure of claim 15, wherein each pair of adjacent building panels are joined by the hem portion of the first of said pair of panels engaging the hook portion of the second of said pair of panels.

17. The building panel of claim 15, wherein one of the stiffening ribs has a width in cross section that is different than a width of another of the stiffening ribs in cross section.

* * * * *

UNITED STATES PATENT AND TRADEMARK OFFICE

CERTIFICATE OF CORRECTION

PATENT NO. : 7,647,737 B2
APPLICATION NO. : 10/966760
DATED : January 19, 2010
INVENTOR(S) : Frederick Morello It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 973 days.

Signed and Sealed this

Sixteenth Day of November, 2010

David J. Kappos

David J. Kappos
*Director of the United States Patent and Trademark Office*